United States Patent [19]

Hasselbeck et al.

[11] 3,967,488

[45] July 6, 1976

[54] NECKERFLANGER FOR METAL CANS

[75] Inventors: Richard J. Hasselbeck, Houston; Clarence E. Stiver, Sidney, both of Ohio

[73] Assignee: The Stolle Corporation, Sidney, Ohio

[22] Filed: Feb. 18, 1975

[21] Appl. No.: 550,571

Related U.S. Application Data

[63] Continuation-in-part of Ser. No. 449,728, March 11, 1974, abandoned.

[52] U.S. Cl. ..... 72/355; 72/393; 113/120 AA

[51] Int. Cl.[2] ..... B21D 22/00

[58] Field of Search ..... 72/394, 393, 355, 465, 72/466; 113/7 R, 7 A, 120 AA; 269/48.1

[56] References Cited

UNITED STATES PATENTS

| | | | |
|---|---|---|---|
| 354,568 | 12/1886 | Norton et al. | 72/355 |
| 2,089,476 | 8/1937 | Grotnes | 72/393 |
| 2,131,027 | 9/1938 | French et al. | 113/120 M |
| 2,198,873 | 4/1940 | Hinsdale | 72/355 |
| 3,754,720 | 8/1973 | Gross et al. | 72/393 |
| 3,765,351 | 10/1973 | Kubacki et al. | 113/120 AA |
| 3,782,314 | 1/1974 | Franek | 113/1 G |
| 3,797,431 | 3/1974 | Yoshimura | 113/120 AA |

*Primary Examiner*—Victor A. DiPalma
*Assistant Examiner*—James R. Duzan
*Attorney, Agent, or Firm*—Melville, Strasser, Foster & Hoffman

[57] ABSTRACT

An apparatus is disclosed for simultaneously necking and flanging metal cans. A collapsible mandrel is provided, which in the collapsed condition will accept a can and which in the expanded condition grips the can over its entire inside surface. The mandrel is constructed such that in its expanded condition it presents an uninterrupted cylindrical surface. The mandrel has a groove in the region where the necking-flanging operation is to be performed and an elastic material is seated in the groove. A die ring larger in diameter than said mandrel in its expanded condition is mounted rotatably coplanar with said groove and means are provided to move said die ring radially of the mandrel to produce the necking and flanging operation by cooperation with the elastic material in said groove. Expansion and collapse of the mandrel is accomplished by internal cam structure.

6 Claims, 14 Drawing Figures

NECKERFLANGER FOR METAL CANS

CROSS REFERENCE TO RELATED APPLICATION

This application is a continuation-in-part of Ser. No. 449,728 filed Mar. 11, 1974, now abandoned, in the names of Richard J. Hasselbeck and Clarence E. Stiver.

BRIEF SUMMARY OF THE INVENTION

In the manufacture of metal cans which are ultimately intended to contain a beverage, the normal procedure has been to decorate the formed can by silk screening, printing, or other methods and thereafter to carry out two distinct and separate operations. First a necking operation in which the diameter of the can is decreased by a die or spinning operation for a short distance near the open end. This is followed by a flanging operation in which the end portion of the formed neck is expanded outward to form a flange. The decorated neck and flanged can is then shipped to the beverage manufacturer who fills the can and secures an end to the flange whereby to seal the contents from outside contamination.

The greatest source of leakage in cans, either at the can manufacturer's plant or in the cannery, or both, results from split flanges. Split flanges occur during the flanging operation as a result of the high tensile forces exerted circumferentially on the neck portion of the can by the flanging tools. The tendency for the flanges to split is enhanced by the fact that the metal has been subjected to rather severe cold working during the necking operation. Additionally, the compressive forces exerted by the necking tools cause small "wrinkling" and "doubling" tendencies. These act as stress risers and initiate splitting during the subsequent flanging operation. Split flanges, of course, permit loss of carbonation and contents or contamination and spoilage of the product and split flanges must therefore be avoided.

According to the present invention, the separate and distinct necking and flanging operations are eliminated and replaced with a single operation. There is provided a mandrel which is expandable and collapsible. In the collapsed condition, a can may be seated on the mandrel and removed from the mandrel. In the expanded condition, the mandrel grips the entire inside surface of the can and the exterior surface of the mandrel in the expanded condition is solid, i.e. it exhibits no cracks or seams to the can which would permit the formation of wrinkles.

The mandrel is provided with an annular groove in which an elastic material is seated and a can stop is associated with the mandrel so that when a can is placed on the mandrel, the end of the can which is to be subjected to the necking-flanging operation will overlie the elastic material in the groove. The mandrel has a plurality of relatively large segmental jaws capable of radial movement and between the said jaws there are provided a plurality of cam actuated jaws. When the cam structure is actuated, the cam actuated jaws move outwardly and force the segmental jaws outwardly as well, until in the fully expanded condition the mandrel presents a complete and uninterrupted cylindrical surface which grips the inside of the can. In its fully expanded condition, the mandrel exhibits no cracks or seams to the can body which would permit the formation of wrinkles.

While in the past the necking has been accomplished by a die wheel rolling on the outside of the can, according to the present invention the necking and flanging is accomplished by a die ring having the die configuration on its inside. In this way, nearly "closed-die" conditions are provided and much better control of the material being formed is achieved than by heretofore known methods. The coaction of the die ring against the can end and against the elastic material results in controlling metal flow and eliminates a tendency of the metal to wrinkle in the neck area.

The die ring may either idle or it may be driven at a speed which is synchronized with the peripheral speed of the necked area of the can after forming. If the die ring is driven, an over-running clutch is provided so that the ring speed may be increased by frictional contact with the rotating can. The peripheral speed will of course decrease gradually as the neck is formed and the diameter is reduced until, at the final stages of forming, the drive can again take place through the over-running clutch.

The die ring is mounted for movement radially with respect to the can axis and the die configuration is such as to complete the neck and flange operation simultaneously.

BRIEF DESCRIPTION OF THE SEVERAL VIEWS OF THE DRAWING

In FIG. 11 the mandrel is collapsed and the die ring is centered.

In FIG. 12 the mandrel is expanded and the die ring is centered.

In FIG. 13 the mandrel is expanded and the die ring is forming the neck and flange, and In FIG. 14 the mandrel is collapsed, the die ring is centered and the can is ready for removal from the mandrel.

DETAILED DESCRIPTION

Figure 9:
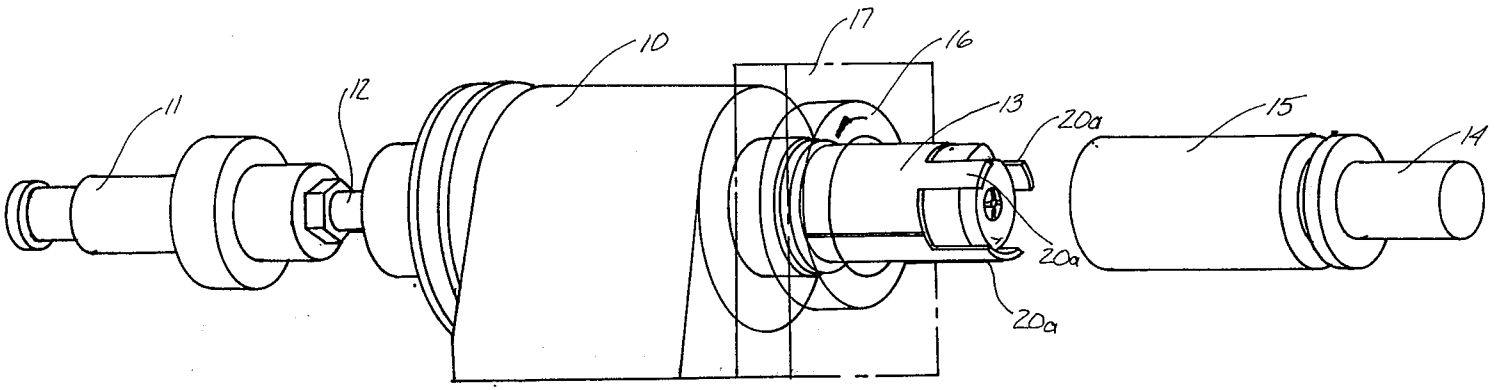
FIG. 9 is a somewhat diagrammatic over-all perspective view of the apparatus.

Reference may be had to FIG. 9 for the general arrangement of the apparatus. In that Figure, a bearing structure is indicated at 10 and a drive shaft is indicated at 11 and may be driven by any means of a suitable source of power, not shown. A shaft 12 is connected by a splined connection to the shaft 11 and is capable of axial movement. Axial movement may be achieved by means of a hydraulic piston or a pneumatic piston or other suitable means (not shown). The mandrel is indicated generally at 13 and a device for feeding cans to the mandrel is indicated at 14 with a can shown at 15 ready to be placed on the mandrel 13. A die ring is indicated at 16 and is rotatably mounted in a suitable frame 17 which is capable of radial movement so that the rotatable die ring 16 may be caused to move radially of the mandrel 13. Again, the frame 17 may be moved by pneumatic or hydraulic means (not shown).

Figure 1:
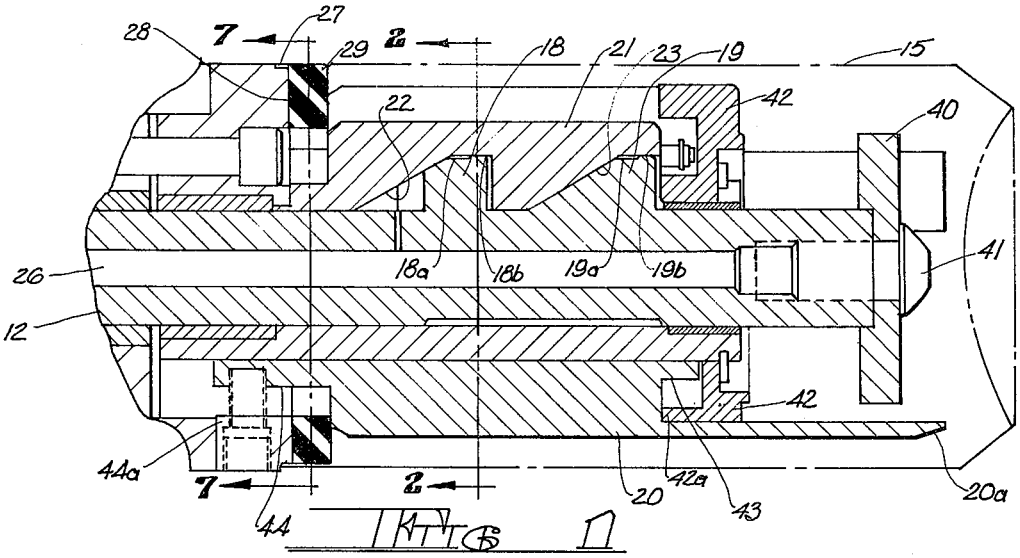
FIG. 1 is a cross sectional view through a mandrel according to the invention in its collapsed condition.
Figure 2:
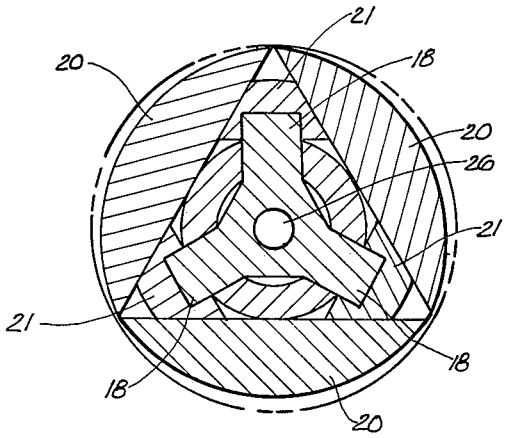
FIG. 2 is a cross sectional view taken on the line 2—2 of FIG. 1, showing the parts in the collapsed condition.
Figure 3:
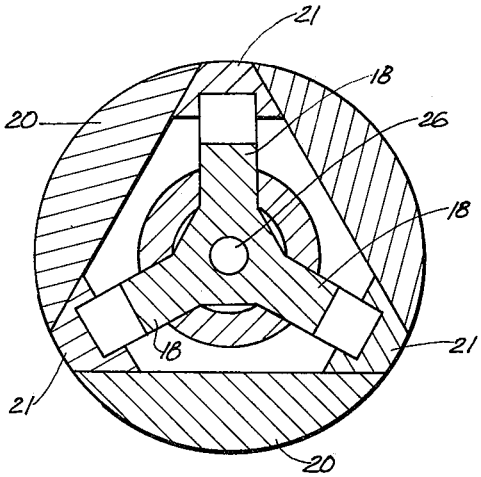
FIG. 3 is a view similar to FIG. 2 but showing the parts in the expanded condition and is taken on the line 3—3 of FIG. 4.

Referring now to FIGS. 1 to 6 inclusive, the shaft 12 is provided with a plurality of cam elements 18 and 19. As seen in FIGS. 2 and 3, in the particular embodiment shown, there are three sets of cams 18 and 19 disposed at 120° to each other. The gripping jaws of the mandrel comprise the three cylinder segments 20 and the three cylinder wedge elements 21. The elements 21 have on their inner surfaces the cam slopes 22 and 23 which cooperate with the cams 18 and 19 respectively. It will be clear from the foregoing, that as the shaft 12 moves toward the left of FIGS. 1 and 4, the cam surfaces 18, 19 cooperating with the surfaces 22 and 23 force the members 21 radially outward. The lateral wedge-like surfaces of the members 21 operate against the flat inner surfaces of the cylindrical segments 20 to force them outward as can be seen by comparing FIGS. 2 and 3. The members 21 have an outer surface which is a part of the cylinder so that when the mandrel is expanded to the condition of FIG. 3, there is a solid cylindrical surface which is presented to the interior of the can. Each of the members 20 is provided with the pins 24 and thus adjacent members 20 are urged toward each other for contraction by means of springs 25 extending between the pins 24. In this way, as the shaft 12 is moved to the right in FIGS. 1 and 4, the springs 25 pull the members 20 back into the condition of FIG. 2.

The cam elements 18 and 19 may be provided with the stepped outer surfaces, furnishing the steps 18*a* and 19*a* and the final outer surfaces 18*b* and 19*b*. The radial height of the final step above the first step may be of the order of 0.010 inch. This configuration, with the cams 22 and 23 in contact with the steps 18*a* and 19*a*, provides sufficient clearance between the mandrel and the can body for easy loading, prior to full expansion, which occurs when the cams 22 and 23 are in contact with the final steps 18*b* and 19*b*.

Figure 4:
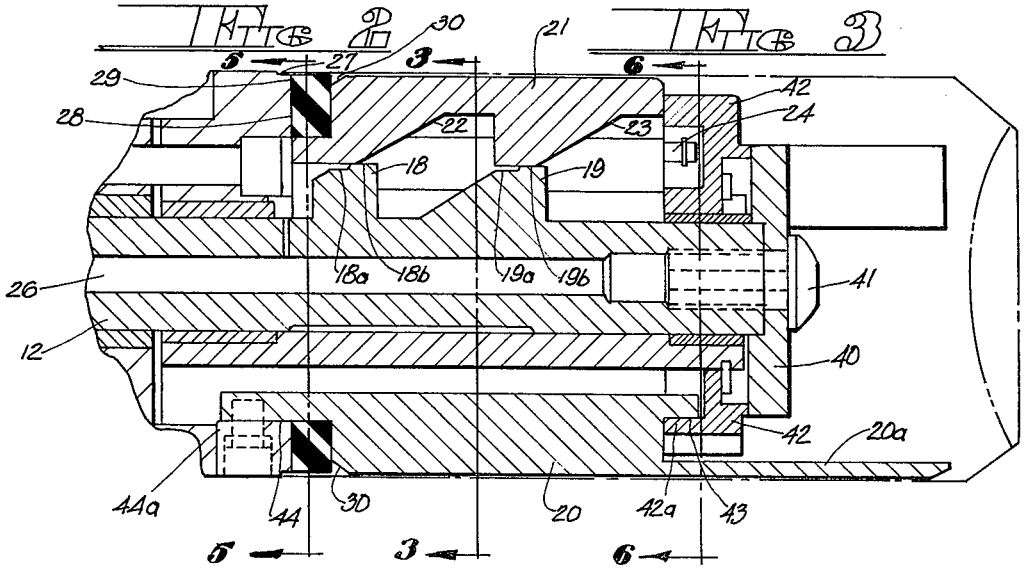
FIG. 4 is a view similar to FIG. 1 but showing the parts in the expanded condition.
Figure 7:
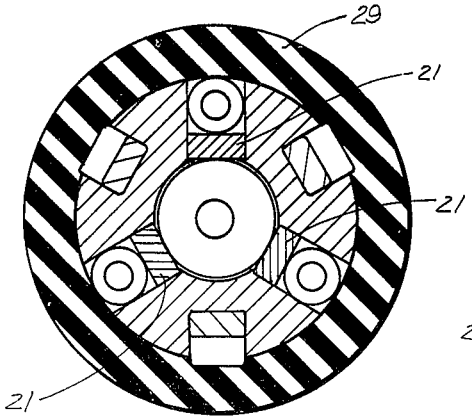
FIG. 7 is a view similar to FIG. 5 taken on the line 7—7 of FIG. 1 showing the parts in collapsed condition.
Figure 5:
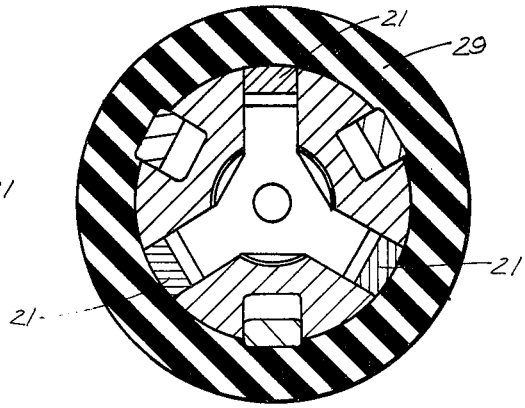
FIG. 5 is a cross sectional view taken on the line 5—5 of FIG. 4, showing the parts in the expanded condition.
Figure 6:
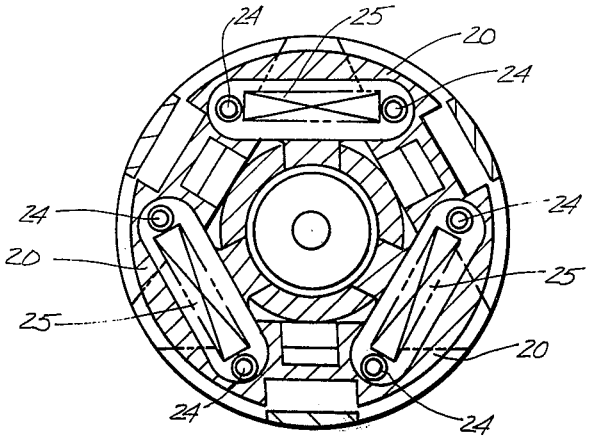
FIG. 6 is a cross sectional view taken on the line 6—6 of FIG. 4.

The movement to the left of the shaft 12 from the position of FIG. 1 to that of FIG. 4 also locks up the expanded mandrel. Secured to the end of the shaft 12 by the bolt 41 is the locking cap 40. As seen in FIG. 4, the cap 40 bears firmly against the floating locking member 42, which locks the segments 20 and 21 against any axial movement. Additionally the expanded segments 20 have the shoulders 43 and 44, which bear against the portions 42*a* of the locking member 42, and the portions 44*a* of the mandrel body.

The shaft 12 may be provided with a bore 26 through which air may be blown to blow off a completed can. The members 20 have the extensions 20*a* which are tapered as shown to facilitate insertion of a can onto the mandrel.

The mandrel is provided with a can stop in the form of a shoulder 27 and a groove 28 is provided within which is seated a member 29 of elastic material such as urethane rubber. The member 29 is located with reference to the can stop 27 such that it is in a position to cooperate with the die ring in the necking-flanging operation as will be described hereinafter. The several members 20 and 21 are chamfered adjacent the groove 28 as indicated at 30 to cooperate with the ring die in the necking phase of the operation.

From what has been said above, it will be clear that with the mandrel in the collapsed condition of FIG. 1, a can (indicated in broken lines at 15 in FIG. 1) can be fed onto the mandrel by means of the feeding device generally indicated at 14 in FIG. 9. The can is fed onto the mandrel until the open end of the can abuts the stop 27. Thereupon the shaft 12 is caused to move toward the left by suitable means (not shown) so as to cause the cam surfaces 18 and 19 to cooperate respectively with the cam surfaces 22 and 23 to force the several members 21 outwardly, thereby in effect spreading the members 20 apart from the condition of FIG. 2 to the complete cylindrical condition of FIG. 3 with no gaps or lines of demarcation between the several segments 20 and 21. Thus, the can is gripped over its entire inside surface. The shaft 12 is then caused to rotate by suitable means (not shown) in order to perform the necking-flanging operation.

Figure 8:
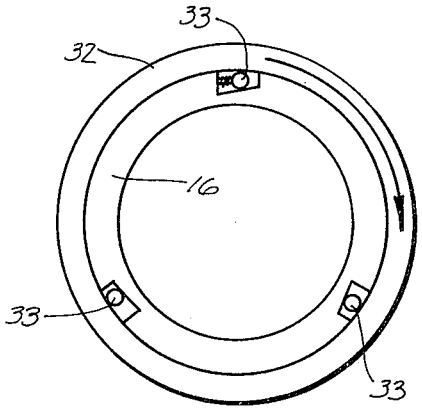
FIG. 8 is an elevational view of the die ring with an over-running clutch.

The die ring has been indicated at 16 in FIG. 9, and it is shown in cross section in FIGS. 10 to 14 inclusive and in elevation in FIG. 8. As previously indicated, the die ring 16 is rotatably mounted in any suitable manner in a frame 17 which is arranged for movement in a radial direction with respect to the axis of rotation of the can. The specific arrangements for moving the frame 17 radially have not been shown to simplify the drawing and such means are well known in the art and within the skill of the mechanic.

Figure 10:
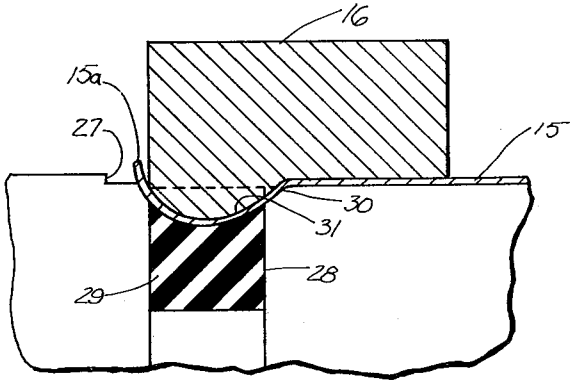
FIG. 10 is an enlarged fragmentary cross sectional view showing a detail of FIG. 13.

The inner surface of the die ring 16 is configured as most clearly seen in FIG. 10 at 31 to depress the wall of the can near its end into the groove 28 against the elastic material 29.

Figure 11:
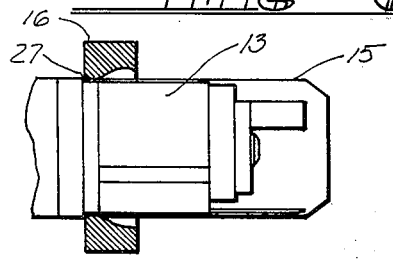
FIGS. 11, 12, 13 and 14 are reduced size views showing the sequence of operations.
Figure 12:
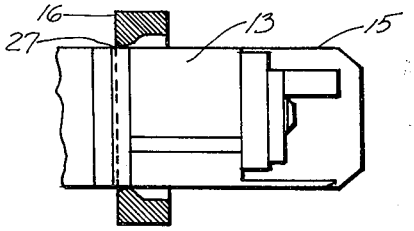
Figure 13:
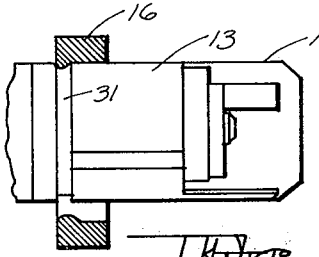
Figure 14:
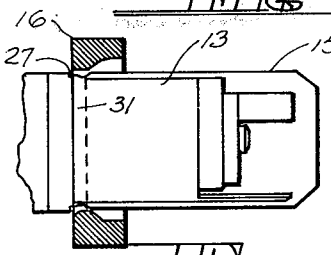

In FIG. 11 the mandrel is in collapsed condition and the die ring is centered. In this condition, the can 15 is placed on the mandrel against the stop 27. In FIG. 12 the mandrel has been expanded to grip the can and the die ring 16 is still centered. At this point, the mandrel is caused to rotate. In FIG. 13 the die ring 16 has been moved radially and is concurrently necking and flanging the can wall at its end. In FIG. 14, the operation has been completed and the die ring is again centered and the mandrel is collapsed so that the can may be removed. Removal of the can may be accomplished in conventional ways as by blowing off by means of air supplied through the passage 26.

By reference to FIG. 10, it will be noted that the flange 15*a* of the can when completed is at nearly the same diameter as it was before the operation commenced. As a result, the stress in the flange area of the can is practically zero throughout the entire operation and thereby splitting tendency is substantially eliminated.

The die ring may be an idler in the frame 17 so that it is caused to rotate by contact with the can during the necking-flanging operation. This has been found in practice to work satisfactorily. However, it may be desirable to drive the flange and if this is done, an over-run clutch is used. If the die ring 16 is to be driven, it is important that the peripheral speed of the inner surface of the die ring be equal to the peripheral speed of the outer surface of the can body. Since peripheral speed varies with the radius about which the body is rotating, it will be understood that as the die ring 16 is moved radially inward, the peripheral speed decreases until at the completion of the necking-flanging operation, the peripheral speed in that area is at its minimum. Therefore, the die ring will be driven at this minimum speed but the over-running clutch will be provided to permit the die ring to be driven faster than its minimum speed during the initial phases of the necking-flanging operation. Thus, the actual drive of the die ring 16 takes over at the end of the necking-flanging operation and during the initial stages the drive is by friction through the over-running clutch. In most cases, the use of the over-running clutch shown in FIG. 8 diagrammatically will not be necessary and entirely satisfactory results may be obtained by a frictional drive between the die ring and the can body. The over-running clutch in FIG. 8 is entirely conventional in that it employs an outer ring 32 with a series of rollers 33 in wedge-shaped recesses so that with relative rotation between the members 16 and 32 in one direction, there is no restraint, whereas in the other direction the rollers 33 wedge and product a drive.

It will now be clear that while in most known expanding mandrels with angular cam surfaces the cam surfaces do the work in a forming operation, in the mandrel of the present invention the cam surfaces expand the mandrel to a cylindrical condition in which they grip the can, and the work is then done by the external tooling, e.g. the tool 16, and the cam segments do no forming work whatever.

It will be clear that numerous modifications may be made without departing from the spirit of the invention. No limitation not specifically set forth in the claims is therefore intended and no such limitation should be implied.

The embodiments of the invention in which an exclusive property or privilege is claimed are defined as follows:

1. Apparatus for simultaneously necking and flanging metal cans, comprising an expansible mandrel adapted in its contracted condition to receive a can to be necked and flanged, a stop associated with said mandrel to determine the axial position of said can with respect to said mandrel, means for expanding said mandrel to grip the interior surface of said can, said mandrel having an annular groove in the region to be necked, and an elastic material in said groove, means for rotating said mandrel, and a rotatable die ring having an inner annular die surface coplanar with said groove, said die ring being larger in diameter than said mandrel to permit a can to be placed on said mandrel and removed therefrom without interference when said die ring is coaxial with said mandrel, and means to move said die ring radially to bring said inner annular die surface into coating relation with said annular groove, to neck and flange a can held on said mandrel simultaneously.

2. Apparatus according to claim 1, wherein said die ring is rotatably mounted in a frame, and means are provided to move said frame radially of said mandrel.

3. Apparatus according to claim 2, wherein said die ring is freely rotatable in said frame, and is caused to rotate by contact with a can on said rotating mandrel.

4. Apparatus according to claim 2, wherein means are provided to drive said die ring rotationally at a surface speed equal to the surface speed of the necked portion of the can at the end of the necking operation, and wherein an overrunning clutch is provided in said drive means to permit said die ring to rotate faster at the beginning of the necking operation.

5. Apparatus according to claim 1, wherein said mandrel in its expanded condition presents an uninterrupted true cylindrical outer surface.

6. In an expandable and contractable mandrel for holding metal can bodies for operations to be performed thereon by external means, comprising an inner member carrying a plurality of outwardly disposed cam surfaces, an equal number of outer members carrying inwardly disposed cam surfaces adapted to coact with said outwardly disposed cam surfaces, means for moving said inner member axially, whereby to cause said outer members to move radially outward, wherein each of said outwardly disposed cam surfaces terminates in a two-step flat, the final step being of the order of .010 inch higher than the first step, whereby when said inwardly disposed cam surfaces rest on said first step, said mandrel is incompletely expanded, and when said inwardly disposed cam surfaces rest on said final step, said mandrel is completely expanded.

* * * * *

UNITED STATES PATENT AND TRADEMARK OFFICE

CERTIFICATE OF CORRECTION

PATENT NO. : 3,967,488

DATED : July 6,1976

INVENTOR(S) : Richard J. Hasselbeck and Clarence E. Stiver

It is certified that error appears in the above-identified patent and that said Letters Patent are hereby corrected as shown below:

Page 1 of patent, at [54] - the title should read

-- NECKER-FLANGER FOR METAL CANS --.

Column 1, line 1, the title should read

-- NECKER-FLANGER FOR METAL CANS --.

Column 6, line 9, "coating" should be -- coacting --.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*